US006858191B2

(12) United States Patent
Mezzedimi et al.

(10) Patent No.: US 6,858,191 B2
(45) Date of Patent: Feb. 22, 2005

(54) THIN TUBE PLATE AND CHAMBER SUPPORT FOR A CHEMICAL REACTOR OR HEAT EXCHANGER

(75) Inventors: Vasco Mezzedimi, Poggibonsi (IT); Lorenzo Barbieri, Avenza (IT); Andrea Ronchieri, Massa (IT)

(73) Assignee: Nuovo, Pignone Holding S.p.A., Florence (IT)

( * ) Notice: Subject to any disclaimer, the term of this patent is extended or adjusted under 35 U.S.C. 154(b) by 115 days.

(21) Appl. No.: 10/259,801

(22) Filed: Sep. 30, 2002

(65) Prior Publication Data

US 2003/0086843 A1 May 8, 2003

(30) Foreign Application Priority Data

Oct. 1, 2001 (IT) ..... MI2001A2034

(51) Int. Cl.[7] ..... B01J 8/02; B01J 8/06; F28D 7/00; F28D 7/16

(52) U.S. Cl. ..... 422/311; 422/196; 422/197; 422/198; 422/201; 422/311

(58) Field of Search ..... 422/196, 197, 422/198, 200, 201, 312, 311

(56) References Cited

U.S. PATENT DOCUMENTS 4,337,224 A * 6/1982 Mahler et al. ..... 422/197
5,266,281 A * 11/1993 Kao et al. ..... 422/197

* cited by examiner

*Primary Examiner*—Alexa Doroshenk
(74) *Attorney, Agent, or Firm*—Nixon & Vanderhye, P.C.

(57) ABSTRACT

A device used as a chemical reactor or heat exchanger in general, with a thin tube plate, of the type in which at least one pipe is connected to a tube plate, this tube plate being closed by a chamber with a container function, wherein this chamber is produced by a section with any shape, with a base which is joined to the plate by a lateral portion; connection elements are also provided between the tube plate and the base of the chamber.

6 Claims, 1 Drawing Sheet

THIN TUBE PLATE AND CHAMBER SUPPORT FOR A CHEMICAL REACTOR OR HEAT EXCHANGER

RELATED APPLICATION

Priority is claimed to Italian application MI2001A 002034, filed Oct. 1, 2001, which is incorporated by reference herein.

BACKGROUND AND SUMMARY OF THE INVENTION

The present invention relates to a device used as a chemical reactor or heat exchanger in general, with a thin tube plate. The present invention also applies to petrochemical and refinery reactors.

Chemical reactors generally consist of large-sized containers inside of which chemical reactions take place at a high temperature and high pressure. The substantially cylindrical body of the chemical reactors generally have a plurality of pipes or tube bundles which carry out various functions, such exchanging heat between two or more operating fluids. These tube bundles are installed and retained in their operative position by tube plates, which in some cases have a large surface area.

Conventional tube plates are produced in a single piece or in several welded pieces. The plates are then finished by drilling or machining. The tube plates are usually designed with a sufficient thickness to withstand the loads expected to be applied to the plates and reactors.

The loads applied to the tube plates may be due to weight, pressure and/or temperatures in an operating chemical reactor. The loads can generate high levels of stresses in the plates. To withstand these stresses, the plates have been made relatively thick. But a thick tube plate may be technically unfeasible in some applications. Where a thin tube plate is needed, then the plates can be thinned and supported with added strength enhancing elements. Various methods for strengthening tube plates are known according to the state of the art. Design codes are also known which regulate the dimensional criteria for the plates and for strengthening the latter.

In general the known tube plate strengtheners consist of reinforcement ribs, which are welded to the thin plates such as to limit the deformations and stresses to which the plates are subjected. These strengtheners are costly and their size, by reducing considerably the useful space for insertion of the tubes on the plates, leads to a significant increase in the diameter of the plates themselves and consequently in the overall diameter of the equipment.

In one embodiment, the present invention eliminates the aforementioned disadvantages and in particular to provide a device which is used as a chemical reactor or heat exchanger in general, with a thin tube plate, which makes it possible to reduce the costs of construction of the device itself. This embodiment provides a device which is used as a chemical reactor or heat exchanger in general. The embodiment includes a thin tube plate which lightens the device and facilitates its installation.

The embodiment also provides a thin tube plate device for use as a chemical reactor or heat exchanger which is safe and reliable when installed. The embodiment further provides a device for use as a chemical reactor or heat exchanger in general with a thin tube plate which is simple and functional.

SUMMARY OF DRAWINGS

The characteristics and advantages of a device used as a chemical reactor or heat exchanger having a thin tube plate according to the present invention will become clearer and more apparent from the following description provided by way of the non-limiting example with reference to the attached schematic drawings, in which.

DETAILED DESCRIPTION OF INVENTION

Figure 1:
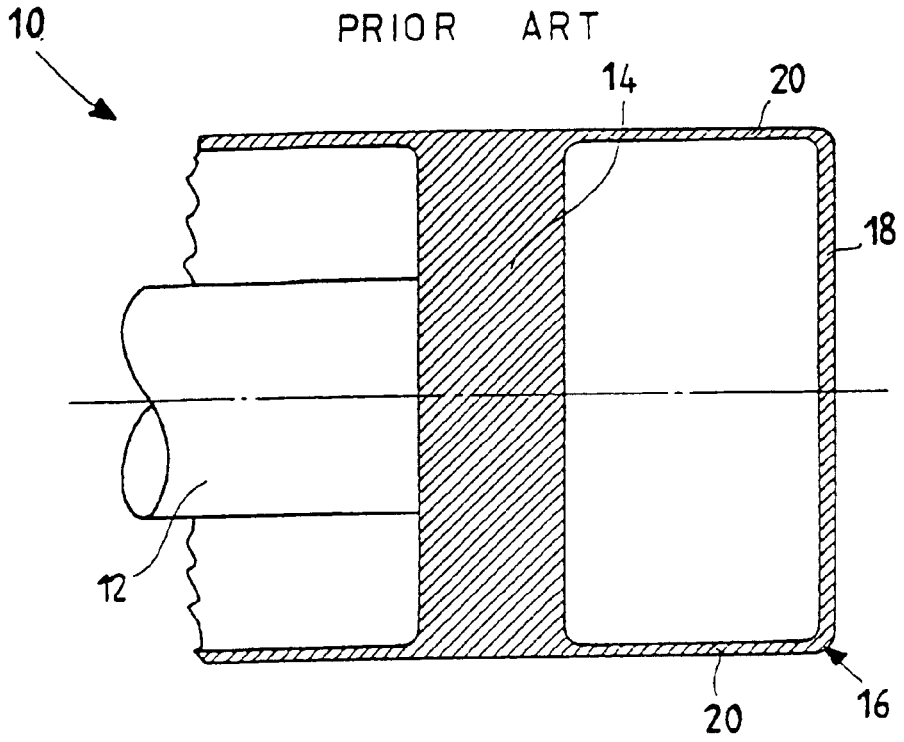
Fig.1 PRIOR ART
FIG. 1 is a cross-section of a device used as a chemical reactor or heat exchanger in general, which shows a pipe connected to a plate, the plate being produced according to the prior art.

FIG. 1 shows a device used as a chemical reactor or heat exchanger in general, indicated as 10 as a whole, according to the prior art. In the example illustrated, the device 10 comprises a pipe system 12. This system comprises pipes which are superimposed and is secured to a tube plate 14 disposed perpendicularly to the axis of the pipes. A chamber 16 which acts as a fluid distributor is connected to the tube plate 14. In the example illustrated, this chamber 16 is produced by means of a section in the shape of a "U", with a base 18 which is joined to the plate 14 by a cylindrical portion 20, with generatrices parallel to the axis of the pipes.

Figure 2:
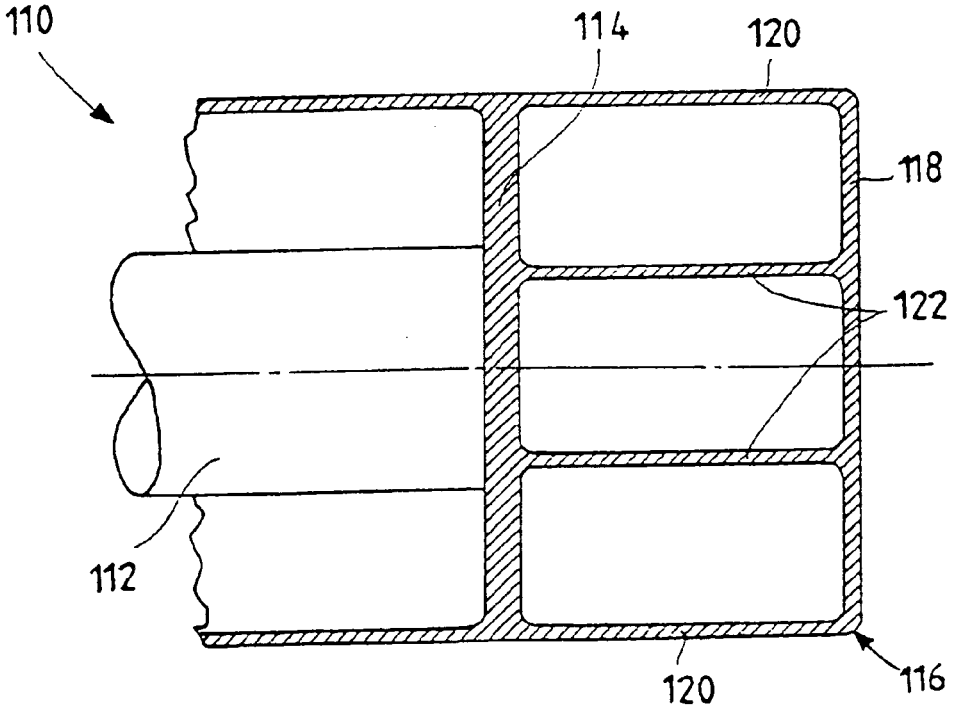
FIG. 2 is a cross-section of a device used as a chemical reactor or heat exchanger in general, which shows a pipe connected to a thin plate, wherein the plate being provided with a system for transfer of the loads according to the present invention.

FIG. 2 shows a device used as a chemical reactor or heat exchanger in general, indicated as 110 as a whole. In the example illustrated, the device 110 comprises a pipe system 112 which is shown schematically in FIG. 2. The pipe system 112 may comprise several pipes which are superimposed and secured to a tube plate 114 disposed perpendicularly to the axis of the pipes 112.

A chamber 116 which acts as a fluid distributor is connected to the tube plate 114. The chamber 116 may be produced in the shape of a "U". The chamber 116 includes a base 118 joined to the plate 114 by a cylindrical or lateral section 120, with generatrices parallel to the axis of the pipes.

The plate 114 of the device 110 is connected at the base 118 of the chamber 116 both by means of the cylindrical portion 120 and by means of connection elements 122 which are disposed inside the cylindrical portion 120. These connection elements 122 are cylindrical or flat portions with a shape similar to the lateral portion 120. The example shows one of these elements 122, disposed axially symmetrically relative to the axis of the pipe 112, although other configurations can be used.

The functioning of the device 110 used as a chemical reactor or heat exchanger in general, is apparent from the foregoing description provided with reference to the figures. In the case of the known art, the loads are transmitted entirely by the device 10 through the plate 14 to the cylindrical portion 20 of the chamber 16. In the device 110 shown in FIG. 2 however, there is more efficient distribution of the loads. The loads are transmitted by the device 110 through the plate 114, both to the cylindrical portion 120 and to the connection elements 122. It is thus possible to use thinner tube plates 114.

The description provided makes apparent the characteristics of the device used as a chemical reactor or heat exchanger in general, with a thin tube plate, as well as certain corresponding advantages including:

lower overall weights of the device and tube plate;

simplification of the installation and of retention of the tube bundle of the tube plate;

lower overall costs and shorter construction times; and simple, reliable and safe use.

The invention can be applied to chemical reactors, petrochemical reactors, refinery reactors, heat exchangers, and in general to tube bundle-type pressure devices.

While the invention has been described in connection with what is presently considered to be the most practical and preferred embodiment, it is to be understood that the invention is not to be limited to the disclosed embodiment, but on the contrary, is intended to cover body, and the coil winding having side sections adjacent the flat surfaces.

What is claimed is:

1. A chemical reactor or heat exchanger comprising:

at least one pipe having a pipe axis;

a thin tube plate having a first side attached to the pipe, wherein said plate is perpendicular to the pipe and an open end of the at least one pipe terminates and is sealed off by the first side of the thin tube plate;

a chamber defined by the thin tube plate and a base opposite and parallel to a second side of the plate and by a lateral section connecting the plate and base, wherein said lateral section includes walls parallel to a pipe wall, and a connection element directly connected to and extending between said base and said tube plate, wherein said connection element is parallel to and aligned with the pipe axis and the connection element is at least partially radially inward of said pipe wall.

2. A device as in claim 1 wherein said connection element is a flat portion similar in shape to said lateral section of the chamber.

3. A device as in claim 1 wherein said connection elements is cylindrical and similar in shape to said lateral section of the chamber.

4. A device as in claim 1 wherein said connection element is within said lateral section of the chamber and is symmetrical about an axis of the pipe, wherein said axis of the pipe is perpendicular to the plate.

5. A device as in claim 4 wherein the connection element is a cylinder and is axially symmetrical about the axis of the pipe.

6. A chemical reactor or heat exchanger comprising:

a pipe having a pipe axis and a pipe wall;

a thin tube plate having a first side attached to the pipe, wherein the plate is in a plane perpendicular to the pipe axis and an open end of the at least one pipe terminates and is sealed off by the first side of the thin tube plate;

a chamber defined by a second side of the thin tube plate and a base plate opposite to the thin tube plate and by a lateral cylindrical section connecting the plate and base, wherein said chamber distributes fluid and said lateral cylindrical section is coaxial with the pipe axis, and a connection element within the chamber and directly connected to and extending between said base plate and said tube plate, said connection element being parallel to and symmetrical about the pipe axis, said connection element structurally supporting the base plate and lateral cylindrical section, wherein the connection element is radially inward of a pipe wall.

* * * * *